US005391325A

United States Patent [19]

Swenson et al.

[11] Patent Number: 5,391,325

[45] Date of Patent: Feb. 21, 1995

[54] NON-TOXIC BIODEGRADABLE EMULSION COMPOSITIONS FOR USE IN AUTOMATIC CAR WASHES

[75] Inventors: Robert A. Swenson, Janesville, Wis.; William E. Welch, Chicago, Ill.

[73] Assignee: Exxon Chemical Patents Inc., Linden, N.J.

[21] Appl. No.: 128,610

[22] Filed: Sep. 29, 1993

[51] Int. Cl.[6] ..... C11D 1/62; C11D 1/38; C11D 3/20; C11D 3/44

[52] U.S. Cl. ..... 252/547; 252/170; 252/153; 252/DIG. 1; 252/DIG. 14; 252/180; 252/357; 252/544

[58] Field of Search ..... 252/547, DIG. 14, 357, 252/153, 358, 170, 173, DIG. 1, 180, 312, 544; 134/36, 40; 427/334, 161; 106/10, 270, 271, 272

[56] References Cited

U.S. PATENT DOCUMENTS

| | | | |
|---|---|---|---|
| 3,222,201 | 12/1965 | Boyle et al. | 252/547 X |
| 3,222,213 | 12/1965 | Clark | 427/348 |
| 3,440,063 | 4/1969 | Chestochowski et al. | 106/10 X |
| 3,457,109 | 7/1969 | Peist | 134/36 X |
| 3,518,099 | 6/1970 | Holbus | 106/10 |
| 3,609,089 | 9/1971 | Cantrell et al. | 134/36 X |
| 3,658,718 | 4/1972 | Clumpner | 252/357 |
| 3,852,075 | 12/1974 | Basadur | 106/11 |
| 4,208,301 | 6/1980 | Gammon | 252/321 |
| 4,547,401 | 10/1985 | Shore | 427/161 |

OTHER PUBLICATIONS

A. Warth, *The Chemistry and Technology of Waxes*, 2nd ed., Reinhold Publishing Corporation, N.Y., 1956, pp. 65–67. No Month Available.

*Primary Examiner*—Christine Skane
*Assistant Examiner*—Douglas J. McGinty
*Attorney, Agent, or Firm*—Jansson & Shupe, Ltd.

[57] ABSTRACT

This invention relates to emulsion compositions which are used as auto spray waxes or rinse or drying aids in automatic car washes. The inventive emulsion replaces mineral seal oil of prior art emulsions with more environmentally acceptable simple esters of natural fatty acids having the general structural formula:

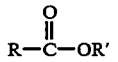

wherein R—C is from an acid moiety having approximately 12–26 carbon atoms, and R′ is from an alcohol moiety having approximately 1–5 carbon atoms. In an additional embodiment, the emulsion composition can include an amine oxide coupling solvent or solubilizer.

10 Claims, No Drawings

NON-TOXIC BIODEGRADABLE EMULSION COMPOSITIONS FOR USE IN AUTOMATIC CAR WASHES

FIELD OF THE INVENTION

This invention is related generally to emulsion compositions which facilitate removal of water from metallic surfaces and, more particularly, to auto spray waxes or rinse or drying aids used in automatic car washes.

BACKGROUND OF THE INVENTION

Since the advent of the commercial car wash, operators of these establishments have searched for a more effective, more economical, and faster method of removing water from freshly washed automobiles. Originally, the water was simply removed manually by wiping with hand towels. As the industry became more mechanized, warm air jets directed at the automobiles were found to be helpful in removing most of the water prior to the final water removal step in which hand towels were utilized.

It was found that the water was more easily removed by the air jets if it was first beaded or formed into droplets. Accordingly, it was discovered that most petroleum and fatty materials when discreetly sprayed onto the surface of the automobile after it had been washed would cause the water to bead and thus facilitate its subsequent removal. Unfortunately, some of these petroleum and fatty materials were harmful to the finish of the automobile; others leave windows streaked and leave unsightly deposits on the automobile; most have no polishing properties. Also, many currently used compositions have become undesirable because of environmental concerns, toxicity, lack of biodegradability or both.

These auto spray waxes or drying aids have also been used in automatic car washes for many years to increase the luster on the automobile finish while aiding in the removal of water from the car surface. Most of these auto spray waxes or drying aids are sold in dilute solutions of about 35%–45% active spray wax and applied to cars in a much more dilute solution. Preferable dilutions for application to an automobile surface are in the range of 0.25% to 2%. A typical standard used to measure the success of these drying or rinse aids is the size of the beads of water. The larger the beads, the more efficiently the water can be blown from the car surface at the end of the washing process.

A typical spray wax or drying aid contains a hydrophobe such as mineral seal oil, an emulsifier such as a quaternary ammonium salt, ethoxylated amines or nonionic surfactants, a glycol ether coupling solvent, and water.

In recent years, with the advent of increased ecological awareness, there has been talk of restricting the use of "oils" or "hydrocarbons" in cationic emulsions that are used to aid in drying cars in car washes. The terms "oils" and "hydrocarbons" are not usually specifically defined when discussed in terms of their removal from rinse aids used in car washes. In Germany where this kind of restriction is already in effect, the definition of "hydrocarbon" is "a substance containing only carbon and hydrogen." This leads to an assumption that the German law may be used to provide similar definitions in United States regulations in the future. Clearly, mineral seal oil would fall within this definition. Therefore, it would be desirable to make an emulsion composition which facilitates the removal of water from automobile surfaces and leaves a high luster thereon without the use of mineral seal oil, and possibly also without the use of glycol ethers, some of which have significant toxicity.

The present invention is directed to such an emulsion composition which provides generally a composition which facilitates removal of water from automobile surfaces and which leaves a high luster thereon.

OBJECTS OF THE INVENTION

It is an object of this invention to provide an improved emulsion composition for use as an auto spray wax or drying aid in automatic car washes which overcomes some of the problems and shortcomings of those of the prior art.

Another object of this invention is to provide an improved emulsion composition for use as an auto spray wax or rinse aid in automatic car washes which replaces mineral seal oil with a more environmentally acceptable material without sacrificing performance.

It is a further object of this invention to provide an emulsion composition for use as an auto spray wax or rinse aid in automatic car washes which replaces the glycol ether solvent with a more environmentally acceptable material without sacrificing performance.

These and other important objects will be apparent from the following descriptions of this invention which follow.

SUMMARY OF THE INVENTION

This invention includes an emulsion composition for use as an auto spray wax or drying or rinse aid used in automatic car washes. It overcomes certain well-known environmental problems and deficiencies of the prior art, including those outlined above. An important aspect of this invention is the ability to replace the hydrophobe component of the prior art, commonly mineral seal oil, with simple esters of natural fatty acids having the general structural formula:

$$R-\overset{\overset{\displaystyle O}{\|}}{C}-OR'$$

wherein R—C is from an acid moiety which contains approximately 12–26 carbon atoms and R′ is from an alcohol moiety containing 1–5 carbon atoms. Another important aspect of this invention is the ability to substitute an amine oxide for the glycol ether solvent commonly used in such compositions.

The improved emulsion compositions can comprise simple esters of natural fatty acids, an emulsifier component having at least one emulsifier selected from quaternary ammonium salts, ethoxylated amines, nonionic surfactants and a glycol ether coupling solvent or solubilizer, without sacrificing composition performance. Such emulsion compositions can then be diluted with water to the desired concentration. Further, the emulsion composition can include an amine oxide instead of a glycol ether coupling solvent or solubilizer.

Thus, the improved emulsion compositions for use as a rinse or drying aid of the present invention comprises approximately 30–60% of simple esters of natural fatty acids, 40–55% of a cationic emulsifier and 5–15% of a solubilizer such as a glycol ether.

Alternatively, the improved emulsion composition can include 30–60% of a simple esters of natural fatty acids, 40–55% of a cationic emulsifier and 5–15% of a solubilizer such as an amine oxide.

DETAILED DESCRIPTIONS OF THE PREFERRED EMBODIMENTS

The present invention is directed to an improved car wax or rinse or drying aid for use in automatic car washes. In one embodiment, the improved emulsion composition rinse or drying aid replaces the mineral seal oil of old emulsion compositions with simple esters of natural fatty acids. Such an emulsion composition includes approximately 30–60% of a simple ester of natural fatty acids, approximately 40–55% of a cationic emulsifier and approximately 5–15% of a solvent or solubilizer. Preferable emulsion compositions include approximately 38–48% of a simple ester of natural fatty acids, approximately 40–50% of a cationic emulsifier and approximately 5–15% of a solvent or solubilizer. These esters of natural fatty acids can be substituted for mineral seal oil with only slight modification of the formula to a higher hydrophilic lipophilic balance (HLB).

The HLB concept is most important in selecting a suitable surfactant that will satisfactorily emulsify or solubilize given ingredients at a given temperature. This means that the hydrophile lipophile balance of the surfactant is the most useful concept in the studies of emulsions, solubilization, microemulsions and many other applications. The HLB is a way of classifying emulsions for solubility. The higher the HLB, the more water soluble an emulsifier is; the lower the HLB, the more oil soluble an emulsifier is. Such an ester has the general structural formula:

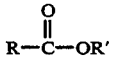

where R—C is from an acid moiety which contains approximately 12–26 carbon atoms and R′ is from an alcohol moiety and contains approximately 1–5 carbon atoms. In preferred embodiments, R is derived from a fatty acid containing 18 carbon atoms with some unsaturation and R′ is preferably derived from an alcohol containing approximately 1–4 carbon atoms.

Suitable esters include methyl oleate, butyl oleate, methyl soyate, methyl lardate, methyl cannolate, amyl laurate, methyl rapeseedate and butyl tallate. Preferred esters include methyl oleate, butyl oleate, butyl tallate, amyl laurate and methyl rapeseedate. Highly preferred esters include methyl oleate, butyl oleate and butyl tallate. Methyl oleate is available from Chemol Company, Farrow Corporation—Keil Chemical Division, Hodag Chemical Corporation, Humko Chemical Division, Witco Chemical Corporation, Norman Fox and Company, Stepan Company and Unichema Chemicals, Inc. Butyl oleate is available from Anar Chemical Company, of Addison, Ill., Sea-Land Chemical Company, of West Lake, Ohio, Inolex Chemical Company, of Philadelphia, Pa., Pro Chem Chemicals, Inc., of High Point, N.C., and Keil Chemical Division of Farrow Corporation, of Hammond, Ind. Butyl tallate is commonly available from Technichem, Inc., of Merchantville, N.J.

Additionally, blends of various esters of natural fatty acids have proven successful in replacing the mineral seal oil component of such emulsion compositions. One such blend, Tofax 9910, from Molex Company, Inc., of Athens, Ala., has proven particularly successful in replacing the mineral seal oil. Tofax 9910 contains a blend of methyl esters of fatty acids.

The emulsifier component of the emulsion composition is responsible for plating the hydrophobe, i.e. the simple esters of natural fatty acids, onto the car's surface. Such emulsifiers can be quaternary ammonium salts, ethoxylated amines or nonionic surfactants. The emulsifier component can be one emulsifier or a blend of various emulsifiers. Preferably, at least one of the emulsifiers should be cationic. One such cationic emulsifier, an amido amine quaternary is available from Exxon Chemicals, Tomah Products Division, of Milton, Wis. under the designation Emulsifier Four.

Other suitable cationic emulsifiers include ether amine quaternaries such as (isodecyloxypropyl, bis-[2-hydroxyethyl] methyl ammonium chloride available from Exxon Chemicals, Tomah Products Division of Milton, Wis. under the designation Q-14-2 and isotridecyloxypropyl dihydroxyethyl methyl ammonium chloride, available from Exxon Chemicals, Tomah Products Division, of Milton, Wis. under the designation Q-17-2. Other suitable cationic emulsifiers are dicoco dimethyl ammonium chloride, oleyl imidazoline salts, and tallow diamine salts. Additionally, the emulsion composition includes a strong solvent which greatly aids the coupling of incompatible fluids like oil and water, or high-molecular-weight esters in water. Such a solvent also smooths the viscosity-reduction curve so that thickening and gelation do not occur when the emulsion is diluted with water. Such gelation can cause problems in automatic car washes when it is desired to inject a concentrated spray wax or drying aid into a rinse water stream, or even when just mixing a concentrate with water in a tank. Suitable solvents include glycol ethers, such as ethylene glycol monobutyl ether.

Additionally, surfactants such as amine oxides having the general structural formula:

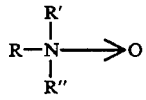

wherein R, R′ and R″ are alkyl or aryl substituents, can be used. Preferably the amine oxide is an ether amine oxide. Such ether amine oxides have the general structural formula:

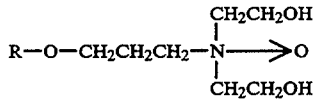

wherein R can be an alkyl carbon chain, a cycloalkyl carbon chain, an aralkyl carbon chain or a substituted aryl carbon ring having 3–26 carbon atoms. Preferably, R is an alkyl carbon chain. In highly preferred embodiments, R is branched and has 6–26 carbon atoms. Preferably, the ether amine oxide is highly branched and is a liquid at room temperature. One particularly preferred ether amine oxide is isodecyloxypropyl bis-[2-hydroxyethyl] amine oxide, available from Exxon Chemicals, Tomah Products Division, of Milton, Wis. under the designation AO-14-2. Use of amine oxides provides the necessary coupling and viscosity reduction and results in clear, stable emulsions that can be reduced with water to about 40% active spray waxes or less without gelation. The 40% active dilutions of the formulations were stable at 120° F. and passed one freeze-thaw cycle.

EXAMPLES AND COMPARISONS

The inventive emulsion compositions were compared to a standard, prior art formulation in what is commonly known as the "split hood test". This test involves use of a clean automobile hood. Onto one-half of the automobile hood is poured a dilute solution of the standard formulation while simultaneously, a dilute solution of one of the inventive emulsion compositions is poured onto the other half of the automobile hood. Each composition was poured at the same rate and pouring was ended at the same time. Observations were made as to how well each side beaded at this point. Next, cold water was used to rinse each half of the hood and observations were again made to compare the size and speed of beading on each half of the hood. Such tests were performed at ambient temperatures in the low 40's° F., which is a rigorous testing temperature for spray waxes or rinse or drying aids. The standard formulation included 15.0 grams (g) of Tomah Emulsifier Four, 1.0 g of SURFONIC N-95 (a nonionic surfactant available from Texaco, Inc., of Austin, Tex.), 3 g of ethylene glycol n-butyl ether, and 20 g of Kerr McGee mineral seal oil. These materials were combined and mixed until homogeneous with a spatula. 61 g of tap water was then added in approximately 10-ml increments with stirring between each addition. After going through a hazy phase, the mixture cleared when about ⅓ of the water had been added and stayed clear when all of the water was in the emulsion, making what is termed a "39% active spray wax". Each of the following compositions was then compared in the split hood test to this standard formulation. 3 g of 39% active solution was dissolved in 1 gallon of water and was applied to one half of the hood. Each of the inventive compositions were prepared and applied in the same manner.

| EXAMPLE 1 | |
|---|---|
| Emulsifier Four | 17.5 g |
| E-T-15 | 2.5 g |
| Ethylene glycol n-butyl ether | 3.0 g |
| Butyl oleate | 16 g |
| Water | 61 g |

E-T-15 is an ethoxylated tallow amine, available from Exxon Chemicals, Tomah Products Division, of Milton, Wis. This mixture remained clear throughout the water addition, although it got quite viscous when about half of the water had been added. When this composition was compared to that of the standard, it exhibited a rate of drying almost identical to the standard.

| EXAMPLE 2 | |
|---|---|
| Emulsifier Four | 14.3 g |
| Q-14-2 | 4.1 g |
| Ethylene glycol butyl ether | 3.1 |
| Methyl Cannolate | 17.5 g |
| Water | 61.0 g |

This mixture remained clear throughout the water addition and was easily diluted. When this composition was compared to the standard, it exhibited a rate of drying slower than that of the standard.

| EXAMPLE 3 | |
|---|---|
| Emulsifier Four | 14.4 g |
| Q-14-2 | 4.0 g |
| Ethylene glycol butyl ether | 3.1 g |
| Methyl Lardate | 17.5 g |
| Water | 61.0 g |

This mixture remained clear throughout the water addition and was easily diluted. When this composition was compared to the standard, a rate of drying slower than that of the standard was observed.

| EXAMPLE 4 | |
|---|---|
| Emulsifier Four | 16.4 g |
| Q-14-2 | 2.0 g |
| Ethylene glycol butyl ether | 3.1 g |
| Amyl Laurate | 17.5 g |
| Water | 61.0 g |

This mixture remained clear throughout the water addition and was easily diluted in water. When this composition was compared to the standard, it exhibited a rate of drying slightly slower than that of the standard.

| EXAMPLE 5 | |
|---|---|
| Emulsifier Four | 13.3 g |
| Q-14-2 | 5.1 g |
| Ethylene glycol butyl ether | 3.1 g |
| Methyl Soyate | 17.5 g |
| Water | 61.0 g |

This mixture remained clear throughout the water addition and was easily diluted. When this composition was compared to the standard it exhibited a rate of drying slower than that of the standard.

| EXAMPLE 6 | |
|---|---|
| Emulsifier Four | 13.4 g |
| Q-14-2 | 5.0 g |
| Ethylene glycol butyl ether | 3.1 g |
| Methyl Rapeseedate | 17.5 g |
| Water | 61.0 g |

This mixture remained clear throughout the water addition and was easily diluted. When this composition was compared to that of the standard, it exhibited a rate of drying slightly slower than that of the standard.

| EXAMPLE 7 | |
|---|---|
| Emulsifier Four | 16.2 g |
| Q-14-2 | 2.2 g |
| Ethylene glycol butyl ether | 3.1 g |
| Butyl Tallate | 17.5 g |
| Water | 61.0 g |

This mixture remained clear throughout the water addition and was easily diluted. When this composition was compared to the standard, it exhibited a rate of drying almost identical to that of the standard.

Therefore, after several comparisons on several vehicles, the formulations were ranked as follows:

Standard, Example 1 and Example 7, almost identical;

Example 4 and Example 6, slightly less effective than standard;

Examples 2, 3 and 5, least effective, but still acceptable on most cars tested.

In order to produce formulations without glycol ether, an amine oxide, Tomah AO-14-2, 50% active in water/isopropanol was used. Examples of these emulsion compositions are as follows:

| | |
|---|---|
| **EXAMPLE 8** | |
| Emulsifier Four | 10.0 g |
| Dicoco dimethyl ammonium chloride | 3.0 g |
| AO-14-2 | 5.0 g |
| Q-14-2 | 6.0 g |
| Methyl Tallate | 16.0 g |
| Water | 60.0 g |
| **EXAMPLE 9** | |
| Emulsifier Four | 13.0 g |
| AO-14-2 | 6.0 g |
| Q-14-2 | 5.0 g |
| Methyl Tallate | 15.0 g |
| Water | 61.0 g |
| **EXAMPLE 10** | |
| Emulsifier Four | 14.5 g |
| AO-14-2 | 5.0 g |
| Q-14-2 | 1.5 g |
| Butyl Oleate | 18.0 g |
| Water | 61.0 g |
| **EXAMPLE 11** | |
| Emulsifier Four | 13.5 g |
| AO-14-2 | 5.0 g |
| Q-14-2 | 2.0 g |
| Amyl Laurate | 19.0 g |
| Water | 60.5 g |

Discussion

Each of these Examples 8 through 11, were compared to the original standard formulation previously discussed using the "split hood test" method. Each of the compositions in Examples 8 through 11 were all clear and could be diluted with water to clear solutions. When the standard formulation was compared to the formulation of Example 8, the result showed that the composition of Example 8 was slightly better in rate of drying than the standard. The composition of Example 9 compared to the standard showed that on initial break, the formulation of Example 9 exhibited a faster rate of drying than the standard formulation. The overall ranking of the formulations 8 through 11 based on the split hood test were that Example 11 was the best, Examples 9 and 10 closely followed with Example 12 slightly behind. However, all of these compositions exhibited faster or almost identical rates of drying when compared to the standard.

Split hood tests at various time intervals was done where the standard formulation was compared to that of Example 11. The formulation of Example 11 was used on the car hood's left side and the standard formulation containing mineral seal oil was used on the car's right side.

Clearly, it was seen that the left side beaded and dried more quickly than that of the right side of the automobile which utilized the standard formulation.

While the principles of this invention have been described in connection with specific embodiments, it should be understood clearly that these descriptions are made only by way of example and are not intended to limit the scope of the invention.

What is claimed:

1. A composition for use as a rinse aid in automatic car washes comprising:

30–60% of a simple ester of natural fatty acids having the general structural formula:

$$R-\overset{\overset{\displaystyle O}{\|}}{C}-OR'$$

wherein R—C is from an acid moiety having approximately 12–26 carbon atoms, and R′ is from an alcohol moiety having approximately 1–5 carbon atoms;

40–55% of an emulsifier component, said emulsifier component including at least one cationic emulsifier; and 5–15% of a coupling solubilizer.

2. A composition as in claim 1 wherein the emulsifier component further includes at least one emulsifier selected from the group consisting of quaternary ammonium salts, ethoxylated amines and nonionic surfactants.

3. An emulsion composition as in claim 1 wherein the ester of natural fatty acids is selected from the group consisting of methyl oleate, butyl oleate, methyl soyate, methyl lardate, methyl cannolate, amyl laurate, methyl rapeseedate and butyl tallate.

4. A composition as in claim 1 wherein the coupling solubilizer is a glycol ether.

5. A composition as in claim 1 wherein the coupling solubilizer is an amine oxide.

6. A composition as in claim 5 wherein the amine oxide is an ether amine oxide.

7. A composition as in claim 1 wherein the cationic emulsifier is an amido amine quaternary.

8. A composition as in claim 1 wherein the simple ester of natural fatty acids is 38–48% of the composition.

9. A composition as in claim 1 wherein the emulsifier component is 40–50% of the composition.

10. A composition as in claim 1 wherein R is derived from a fatty acid containing 18 carbon atoms with some unsaturation and R′ is derived from an alcohol containing approximately 1–4 carbon atoms.

* * * * *